US006092572A

United States Patent [19]

Green

[11] Patent Number: 6,092,572

[45] Date of Patent: Jul. 25, 2000

[54] LOG SPLITTER WITH MANUALLY OPERATED HYDRAULIC JACK

[75] Inventor: William R. Green, Avon, Ind.

[73] Assignee: Extant Inc., Avon, Ind.

[21] Appl. No.: 09/280,143

[22] Filed: Mar. 26, 1999

Related U.S. Application Data

[60] Provisional application No. 60/079,398, Mar. 26, 1998.

[51] Int. Cl.[7] ..... B27L 7/00

[52] U.S. Cl. ..... 144/195.1; 144/193.1; 144/366; 144/195.8

[58] Field of Search ..... 144/193.1, 195.1, 144/195.8, 366, 195.4

[56] References Cited

U.S. PATENT DOCUMENTS

| | | | |
|---|---|---|---|
| 2,704,093 | 3/1955 | Brown | 144/195.1 |
| 3,285,304 | 11/1966 | Fuller | 144/193 |
| 3,982,572 | 9/1976 | Kortendick | 144/193 |
| 4,102,373 | 7/1978 | Winiasz | 144/195.1 |
| 4,192,364 | 3/1980 | Findley | 144/193 |
| 4,293,012 | 10/1981 | Pierrat | 144/193 |
| 4,300,605 | 11/1981 | Pierrat | 144/193 |
| 4,314,591 | 2/1982 | Pierrat | 144/193 |
| 4,331,192 | 5/1982 | Hung | 144/193 |
| 4,357,973 | 11/1982 | Pierrat | 144/193 |
| 4,366,848 | 1/1983 | Gavinski | 144/193 |
| 4,377,190 | 3/1983 | Pierrat | 144/193 |
| 4,445,554 | 5/1984 | Suzuki | 144/195.1 |
| 5,535,795 | 7/1996 | Bunn | 144/195.1 |
| 5,575,319 | 11/1996 | Chick | 144/195.4 |

FOREIGN PATENT DOCUMENTS

| | | | |
|---|---|---|---|
| 260184 | 3/1988 | European Pat. Off. | 144/195.1 |

*Primary Examiner*—W. Donald Bray
*Attorney, Agent, or Firm*—Woodard, Emhardt, Naughton, Moriarty & McNett

[57] ABSTRACT

A compact, lightweight, easily operated log splitter having a conventional manually operated hydraulic jack mounted on a base in an adjustable-length frame having four legs extending between the base and a plate supporting a splitting wedge at the opposite end of the frame.

11 Claims, 2 Drawing Sheets

LOG SPLITTER WITH MANUALLY OPERATED HYDRAULIC JACK

CROSS-REFERENCE TO RELATED APPLICATION

This application claims the benefit of U.S. Provisional application Ser. No. 60/079,398, filed Mar. 26, 1998.

BACKGROUND OF THE INVENTION

This invention relates to log splitting devices and more particularly to log splitters using conventional manually operated automotive jacks.

Numerous log splitting devices have been devised in the past as exemplified by the devices disclosed in the following patents:

| Patent No. | Inventor | Issue Date |
|---|---|---|
| 4,192,364 | Findley | Mar. 11, 1980 |
| 4,331,192 | Hung | May 25, 1982 |
| 4,366,848 | Gavinski | Jan. 4, 1983 |
| 4,377,190 | Pierrat | Mar. 22, 1983 |
| 5,535,795 | Bunn | Jul. 16, 1996 |
| 5,575,319 | Chick | Nov. 19, 1996 |

The above-identified Gavinski patent discloses an example of the self-contained trailer-mounted type of log splitter that has become commonplace for splitting logs for fireplace use. Log splitters of this type have a large hydraulic cylinder which is typically powered by a gasoline engine, and are very heavy, cumbersome, and expensive.

At the other end of the spectrum of log splitting devices are simple hand tools such as axes and mauls as well as handheld wedges which are driven into a log with the aid of a sledge hammer. Such devices are quite inexpensive, but require a degree of strength and dexterity that many unskilled users do not possess, and their initial economy can be vastly offset by the amount of time and energy required to be expended by the user.

A number of attempts have been made to create labor-saving devices in this field which are suitable for home use or other non-commercial use. For example, the above-identified patents to Chick and Bunn both disclose upright log splitters with a conventional step-type manual automotive jack. Log splitters with hydraulic jacks are disclosed in the patents to Findley, Hung and Pierrat. Findley and Hung both disclose horizontal log splitters, while Pierrat discloses an upright log splitter with a hydraulic automobile jack.

Pierrat had the objective of producing a lightweight, low-cost log splitter for home use, but sought to achieve that objective with a two-legged frame having a cross member engaging both legs and abutting the top of a conventional jack resting on the base of the frame. A log to be split was placed on end on the cross member and the cross member was driven upwardly by the jack. Pierrat also proposed the use of an adjustment clamp around each leg that, by design, bites into the surface of the leg to hold the wedge at a desired height. With continued use, such clamps prevent smooth operation of the adjustment mechanism and thereby shorten the useful lifetime of the log splitter.

In spite of all the past activity in this area, there remains a need for a jack-actuated log splitter that is sufficiently powerful and durable for long-term non-commercial use but still simple and lightweight in construction, inexpensive, compact, easily transported, and easy to set up, use and store.

SUMMARY OF THE INVENTION

The present invention meets this need and others by providing a compact, lightweight, easily operated log splitter having a conventional manually operated hydraulic jack secured only at its lower end to a base in a frame having a plurality of legs affixed to the base, and a vertically oriented splitting wedge supported at the opposite end of the frame. The jack has a free upper end exposed for direct contact with a log to be split. Parts count, complexity, cost and weight are reduced relative to designs having crossbars or other support members on top of the jack.

According to another aspect of the invention, a jack-actuated log splitter includes a frame having an adjustable overall height. A plurality of telescoping legs are affixed to the base and upper support member of the frame. A wedge is mounted on the upper support member in a vertical orientation, and a manually operable hydraulic jack is provided on the base in a vertical orientation and vertically aligned with the wedge. The collapsible construction provides the significant advantage of making the device compact for storage and transport, while maintaining design simplicity, lightweight construction and ease of operation.

In another aspect of the invention, a jack-actuated log splitter is provided with a frame having four parallel legs connected at their lower ends to a base on which a manually operated hydraulic jack is positioned. A vertically oriented wedge is supported above the jack by the frame.

DETAILED DESCRIPTION OF THE PREFERRED EMBODIMENT

Figure 1:
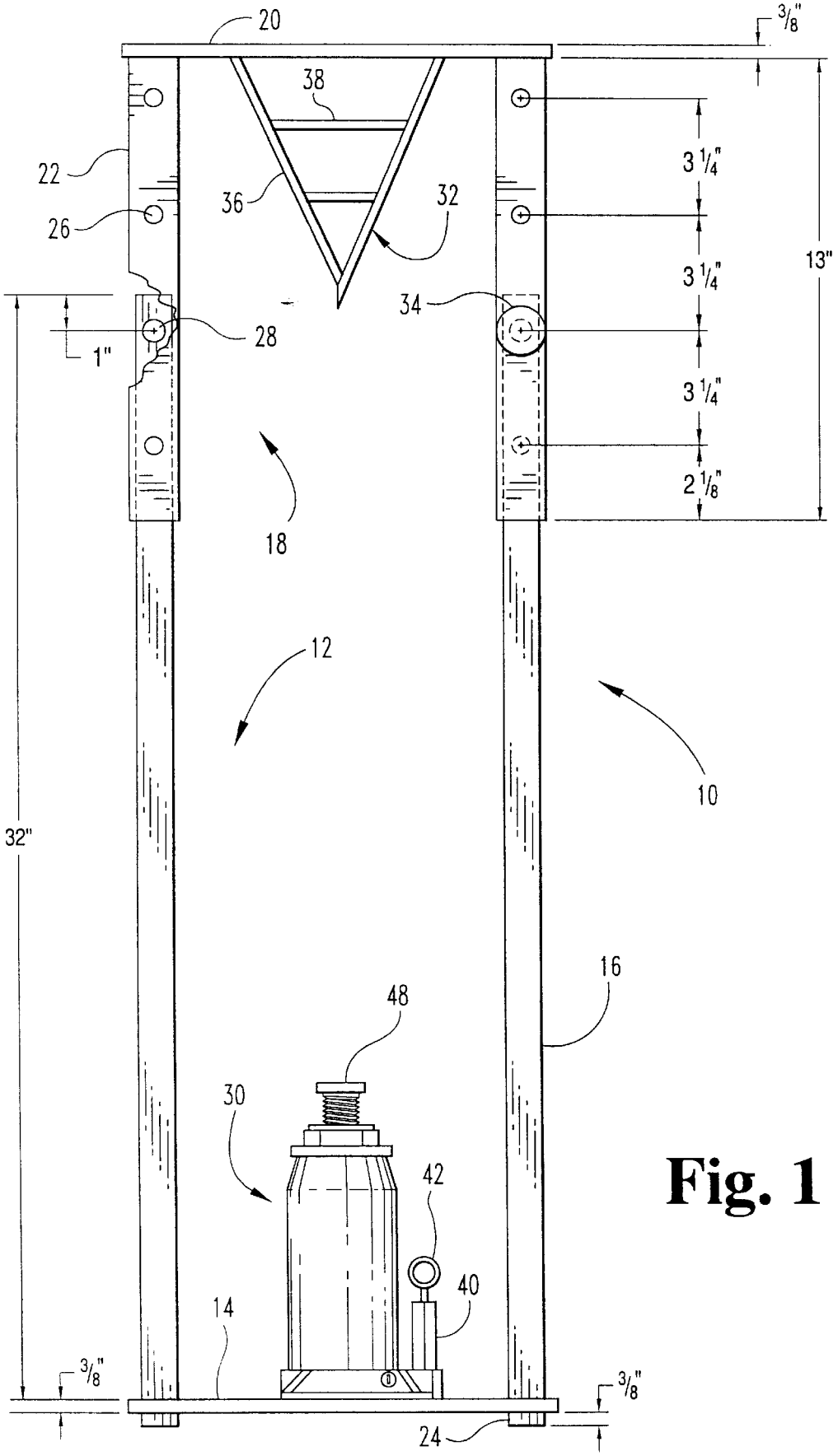
FIG. 1 is a front elevation view of the preferred embodiment of a log splitter according to the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As shown in the drawings, the preferred embodiment of a log splitter 10 according to the present invention has an adjustable-length frame having a bottom portion 12 which includes a base 14 and four square steel pipe legs or leg sections 16 welded or otherwise affixed to the corners of the base, and a top portion 18 which includes a top plate 20 and four square steel pipe legs or leg sections 22 welded or otherwise affixed to the corners of the top plate. The legs affixed to the base are preferably one inch (1") square with a wall thickness of 14 gauge or about 0.083" and with an overall length as shown in FIG. 1. The legs affixed to the top plate are preferably 1⅜" square, with the same wall thickness as the legs and with the overall length as shown in FIG.

Figure 2:
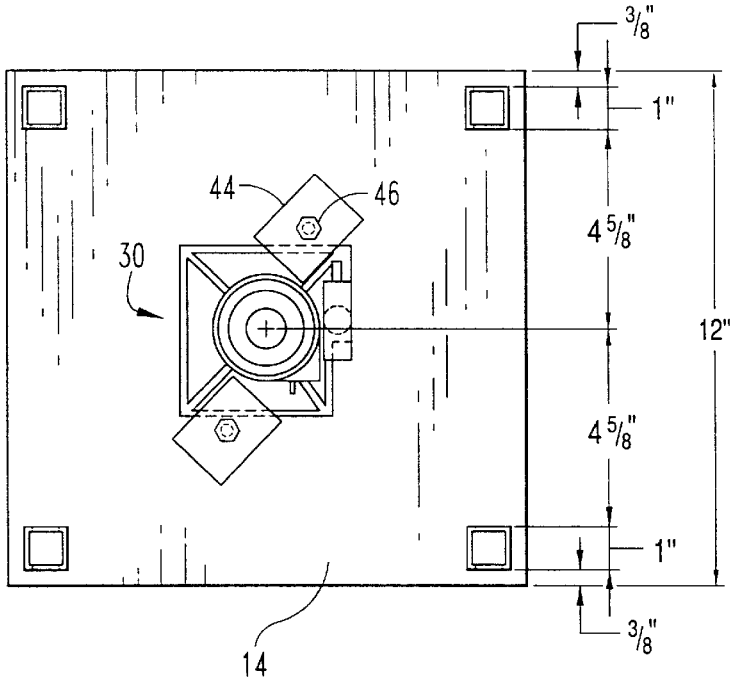
FIG. 2 is a top view of the bottom portion of the log splitter of FIG. 1.
Figure 3:
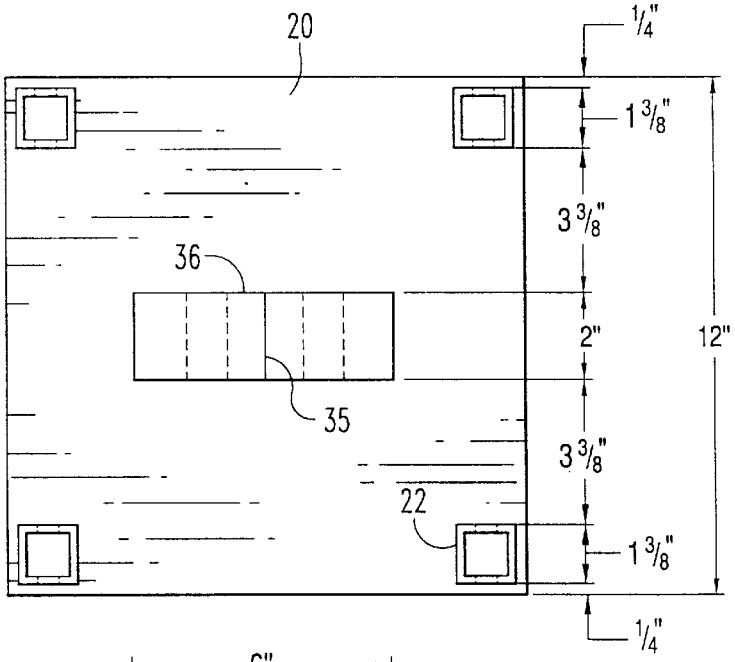
FIG. 3 is a bottom view of the top portion of the log splitter of FIG. 1.

1. The spacing between the legs is as shown in FIGS. 2 and 3. The top and bottom plates are preferably both 12"×12"×⅜" steel plates, and the base plate preferably has four feet 24 welded thereto, one beneath each leg and each formed of a ⅜ length of 1" square steel pipe.

Each of the four legs 22 has four ½" holes 26 spaced along its length as shown in FIG. 1, and each leg 16 has a corresponding ⅝" hole 28 through the leg at a point 1" from the top of the leg as shown in FIG. 1. Steel pipes with a circular cross-section are suitable, but a square cross-section is preferred for the legs because the square cross-section facilitates the drilling of through holes such as holes 26 and 28. Three equilaterally spaced legs may provide adequate strength and stability in some applications, but a four-legged construction is preferred.

As shown in FIG. 1, a hydraulic jack 30 of conventional design known as a bottle jack is mounted on the base and a wedge 32 is mounted on the underside of the top plate. The height of the wedge above the jack is readily adjusted by aligning a selected one of the holes in each leg to the hole in the corresponding leg and holding the legs in the desired position with a pin 34 inserted through the aligned holes in each leg. A pin with a ⅜" diameter is suitable for such purposes, and each of the four pins is preferably 2" long with a head on one end (front side as seen in FIG. 1) and a transverse through hole on the other end to receive a cotter pin (not shown) to retain the pin in place.

Figure 4:
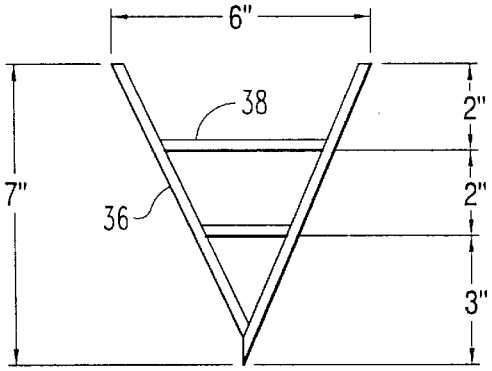
FIG. 4 is a detailed drawing of the wedge shown in FIG. 1.

Although a solid wedge may be suitable in some applications, the wedge 32 is preferably formed of four ¼" thick plates of steel sized and arranged as shown in FIG. 4 with each plate having a 2" width as shown in FIG. 3. The wedge thus has a splitting edge 35 that is 2" long. The wedge has two main wedge faces 36 and two cross members or braces 38 to support the wedge faces. The four plates may be welded together. This wedge construction has been found effective for splitting not only seasoned but also green logs of all typical sizes as cut for conventional home fireplaces.

A suitable bottle jack 30 is commercially available from a number of sources, including Walmart, Sears and Meijer's. For example, a 6-ton jack with the brand name MPV from Meijer's is suitable. A suitable bottle jack is also commercially available from Cummins Tools, e.g., Model QY6D. A lifting capacity of six tons has been found adequate in most applications. Further capacity may be provided with an 8-ton jack, e.g., Cummins Tools Model QY8D, while still meeting desired weight limits, as described below. The log splitter as described herein is also capable of accommodating a 10-ton jack and the splitting forces generated with such capacity. The jack includes an integral pump 40 and a pump lever mechanism which has a sleeve 42 for receiving a pump handle (not shown) which may be an 18" long section of steel pipe with a rubber hand grip on the end away from the pump lever mechanism. The handle is preferably adapted to engage the lever mechanism, i.e., fit into sleeve 42, and also to engage the pressure control valve on the jack base that allows the jack plunger to be raised in response to pump action or lowered by application of external force. The jack is suitably secured to the base plate 14 such as by two locking plates 44 placed over the base of the jack and secured by bolts or other fasteners 46 to the base plate. The jack includes a main cylinder and plunger and may also include a twist top as shown in FIG. 1 and as known to those skilled in the art, and the head 48 of the plunger is free for direct contact with a log to be split. That is, there is no cross member between the legs at the level of the upper end of the jack. It has been found suitable with the construction described to secure the jack only at its lower end, e.g., as shown and described. This construction thus avoids the increased parts count, complexity, cost and weight that would likely be associated with support members at the upper end of the jack, along with possible undesirable side effects.

With the four legs 16, the four legs 22, the base plate 14, top plate 20 and wedge 32, and with a hydraulic jack 30 with six-ton lifting capacity, the total weight of a log splitter 10 according to the preferred embodiment of the present invention is approximately 62 pounds, including the associated jack handle, locking plates 44, locking pins 34 and cotter pins. The corresponding weight with an 8-ton jack is approximately 69 pounds. The log splitter as described above can be collapsed down to a compact 12"×12"×33" unit and extends out to about 43" in length in its fully extended state. Due to its construction and light weight, the log splitter is easy to set up and use and thereafter store away and also is easily transported. A particular advantage of the weight specified above is that it is low enough to meet weight limits imposed by most nationwide package delivery companies for shipment at regular rates. For example, UPS has a weight limit of 70 pounds. This facilitates mail order shipments of the log splitter in a single package without any surcharge for excess weight.

The log splitter is preferably provided with a protective coating of powdered plastic sprayed in a fine layer onto the steel members of the log splitter which are electrostatically charged for this process. The coated steel members are then baked in an oven, melting the plastic so that it sticks permanently to the steel. The protective powder coating allows the device to remain outside exposed to the elements, e.g., on a wood deck or patio.

The cost of materials and the manufacturing costs are kept to a minimum due to the simple design of the log splitter. It is possible that hydraulic oil might need to be added to the jack occasionally, but the unit is otherwise essentially maintenance-free.

The device is very easy to operate in part due to the hydraulic jack, which provides for physically easy, smooth application of force. In operation, the log splitter is positioned in an upright position as shown in FIG. 1, and a log is placed endwise onto the jack and held in position with one hand by an operator while the jack handle is pumped with the other hand to raise the jack. The jack is raised to force the other end of the log against the splitting wedge such that the log is split and the two halves are forced by the wedge to fall harmlessly away to opposite sides of the log splitter.

The log splitter eliminates the need to swing a large axe or maul to split logs and does so without the much greater expense of trailer-mounted log splitters, and without the extra parts count and complexity of some other designs. Compared to other known log splitters, it greatly reduces the degree of skill and effort required to split logs for use in a fireplace.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A jack-actuated log splitter, comprising:

a frame having an adjustable overall height, said frame including a base, an upper support member, and a plurality of telescoping legs affixed to said base and upper support member;

a wedge mounted on said upper support member in a vertical orientation; and a manually operable hydraulic jack on said base in a vertical orientation and vertically aligned with said wedge.

2. The log splitter of claim 1, wherein said jack has a main cylinder and plunger and an integral pump and is secured at a lower end thereof to said base with said plunger vertically aligned with said wedge, said jack further having a free upper end exposed for direct contact with a log to be split.

3. The log splitter of claim 2, wherein said wedge has a horizontally oriented splitting edge approximately two inches in length.

4. The log splitter of claim 3, wherein said frame includes an upper plate extending over said legs, and wherein said wedge is affixed to said upper plate.

5. The log splinter of claim 4, wherein said frame has four legs.

6. The log splitter of claim 2, wherein said frame includes an upper plate extending over said legs, and wherein said wedge is affixed to said upper plate.

7. The log splitter of claim 2, wherein said frame has four legs.

8. The log splitter of claim 1, wherein said frame is adjustable in discrete increments.

9. The log splitter of claim 8, wherein each of said legs defines a plurality of holes for height adjustment, further comprising a plurality of locking pins insertable into aligned ones of said holes in said legs.

10. The log splitter of claim 1, further comprising means for adjusting said frame in height and securing said wedge in position with respect to said base without gripping said legs.

11. A jack-actuated log splitter, comprising:

a frame having four parallel legs with upper and lower ends, and a base connecting said legs at their lower ends;

a manually operated hydraulic jack on said base; and a vertically orientated wedge supported above said jack by said frame, wherein said legs are telescoping steel pipe legs having a maximum cross-sectional dimension less than 2 inches and a wall thickness less than 1/10 inch, wherein said frame includes an upper support plate connecting said legs at their upper ends, wherein said wedge is affixed to said upper support plate in alignment with said jack, wherein said wedge includes a plurality of steel plates and has a splitting edge approximately two inches in length, and wherein said jack has a lifting capacity of at least six tons and includes an integral pump and associated pump handle, further comprising a plurality of locking plates for securing said jack to said base, and a plurality of locking pins and respective holes in said legs for adjusting said frame in height and securing said wedge in position with respect to said base, and wherein said log splitter has a total weight of less than 70 pounds.

* * * * *